US005187922A

United States Patent [19]

Mast

[11] Patent Number: 5,187,922

[45] Date of Patent: Feb. 23, 1993

[54] APPARATUS AND METHOD FOR TRANSFERRING SIGNATURES TO A WRAPPING MACHINE

[75] Inventor: Monte N. Mast, Eagle, Wis.

[73] Assignee: Quad/Tech, Inc., Sussex, Wis.

[21] Appl. No.: 865,214

[22] Filed: Apr. 8, 1992

[51] Int. Cl.[5] ..... B65B 11/10

[52] U.S. Cl. ..... 53/466; 53/64; 53/229; 53/586; 53/453; 53/559

[58] Field of Search ..... 53/466, 228, 553, 559, 53/586, 64, 229, 453

[56] References Cited

U.S. PATENT DOCUMENTS

| | | | |
|---|---|---|---|
| 2,928,217 | 3/1960 | Case | 53/228 X |
| 3,125,841 | 3/1964 | Anderson | 53/228 |
| 3,513,622 | 5/1970 | Timmerbeil | 53/553 X |
| 3,766,708 | 10/1973 | Kubo | 53/586 X |
| 3,881,089 | 4/1975 | Harkness | 53/553 X |
| 3,928,941 | 12/1975 | Singer | 53/553 |
| 4,313,288 | 2/1982 | Tassi et al. | 53/553 |
| 4,351,142 | 9/1982 | Focke | 53/228 X |
| 4,831,809 | 5/1989 | Tassi et al. | 53/553 |
| 4,991,376 | 2/1991 | Backman | 53/466 |
| 5,069,016 | 12/1991 | Grossi | 53/553 X |

FOREIGN PATENT DOCUMENTS

| | | | |
|---|---|---|---|
| 2422000 | 12/1974 | Fed. Rep. of Germany . | |
| 2827535 | 1/1980 | Fed. Rep. of Germany | 53/53 |

*Primary Examiner*—John Sipos

*Attorney, Agent, or Firm*—Foley & Lardner

[57] ABSTRACT

An apparatus and method for transferring stacked and individual flexible products of variable height such as signatures to a wrapping machine having a continous packaging film includes a conveyor unit for transporting the signatures along a path substantially parallel to the packaging film, a main pushing unit for advancing the signatures transversely across the conveyor unit into the packaging film and a second pushing unit selectively engageable with the packaging film and travelling in advance of the signatures for adjusting the tension of the packaging film to prevent distortion of the signatures during wrapping.

12 Claims, 9 Drawing Sheets

APPARATUS AND METHOD FOR TRANSFERRING SIGNATURES TO A WRAPPING MACHINE

TECHNICAL FIELD

The present invention relates generally to an apparatus and method for manipulating flexible folded and printed products and, more particularly, to an apparatus and method used in the finishing stages of magazine, bookbinding and periodical assembly for transferring stacked signatures to a wrapping machine.

BACKGROUND OF THE INVENTION

It is common practice in the printing industry to protect a signature or a group of signatures from inclement weather and rough handling during their transport to various distribution points. Conventionally groups of stacked and strapped, collated and bound signatures or, in some instances, individual signatures are conveyed to a wrapping machine where the signatures are confined within a transparent or translucent foil of synthetic plastic material for this purpose. The wrapping machines which employ webs of such plastic material are generally designed to loop a single web or strip of plastic material, or to repeatedly unite the leaders of two webs to form a loose loop or envelope for receiving the signatures. The plastic envelope surrounding the signatures is normally cut and sealed by a transversal welding unit after which the packaged signatures are usually conveyed towards an oven where heat shrinking takes place to complete a properly formed, closely sealed package.

There are a limited number of ways commonly accepted for wrapping groups of signatures. In one method, signatures are drawn by a conveyor through a plastic curtain during which a cam driven welding unit supported on a horizontally translatable car is actuated to seal the signatures. Such a method is disclosed in U.S. Pat. No. 4,313,288 issued to Tassi, et al on Feb. 2, 1982, and U.S. Pat. No. 4,831,809 issued to the same inventors on May 23, 1989. U.S. Pat. No. 4,991,376 issued to Backman on Feb. 12, 1991, also discloses a packaging method wherein signatures are conveyed through a plastic curtain. Another method often employed deliberately pushes stacked signatures transversely through a plastic film across a conveyor running generally parallel to the plastic film.

Each of the above methods has drawbacks in applying the proper amount of plastic film for stacks of signatures having variable height. In an attempt to solve this dilemma, various sensing arrangements are utilized at various locations in these packaging machines for selectively metering amounts of plastic film suitably encasing bundles typically ranging in height from less than one inch to nine inches. In addition, a particularly troublesome problem occurs in some machines when individual signatures of low height bundles comprising a relatively small number of stacked signatures are insufficiently stable to traverse the plastic film without distortion. In these cases, the collective flexibility of the signatures is such that the leading edges of the signatures tend to ride upwardly along the plastic film or effect relative movement between the bundle and conveyor and in doing so can compound the problem of proper film payout.

One apparatus which attempts to solve this latter problem is disclosed in aforementioned U.S. Pat. No. 4,991,376. In this arrangement, responsive to the sensing of a particular stacked product, a deflection member for the upper portion of the plastic curtain is displaced so that film is supplied substantially without tensile force, the deflection member being comprised of a movable roller mounted on the end of two vertical cylinder rods. The problem with this apparatus, however, is that plastic film is primarily pulled from an upper roll by the extension of vertical cylinders. Film payout from the lower roll is extracted with the assistance of a suction device on an outfeed conveyor. Without the provision of positively driven plastic film, this apparatus appears dependent upon the stroke length and responsiveness of the cylinders supporting the upper portion of the plastic curtain and it is questionable whether the proper amount of plastic film cam be consistently provided.

From the foregoing, it can be appreciated that an attempt has been made by the prior art to upgrade the wrapping capability for stacked signatures of various heights. However, there remains a need in this well developed art for a system which delivers and packages stacked signatures, especially those of a low height, with a more responsive, positively controlled wrapping function which will more efficiently govern plastic film consumption and minimize bending or buckling of packaged signatures.

SUMMARY OF THE INVENTION

The present invention advantageously provides an improved method and apparatus enhancing the wrapping capability for individual and stacked signatures used in magazines and similar publications. The improved wrapping apparatus provides noteworthy cost savings and is readily adaptable into existing systems with a minimum of modification or retrofitting.

These and other advantages are realized, in one aspect of the invention, by an apparatus for transferring at least one signature into a wrapping machine having a continuous packaging film defined by an upper film portion, a lower film portion and a central film portion about which the signature is wrapped. A conveyor transports the signature along a path substantially parallel to the packaging film while a first pusher advances the signature transversely across the conveyor in the direction of the packaging film. A second pusher in substantially parallel relationship with the first pusher selectively engages the central film portion of the packaging film and precedes the signature for adjusting the tension of the packaging film to prevent distortion of the signature during the wrapping process.

The present invention also relates to a method for transferring at least one flexible product of variable height into a wrapping machine having a continuous packaging film defined by an upper film portion, a lower film portion and a central film portion about which said product is wrapped. The method comprises the steps of applying a primary force against the side of the product to advance the product transversely across a conveyor in the direction of the packaging film, and selectively applying an auxiliary pushing force transversely against the central film portion of the packaging film substantially parallel to the primary force and in advance of the product contacting the packaging film in response to the product having a height less than that of a predetermined level so that the tension of the packaging film is adjusted to prevent distortion of the product during wrapping.

In a highly preferred embodiment, the apparatus further contemplates vertically displaceable packaging film switching arrangements for controlling a driven payout of the upper and lower film portions of the packaging film in response to engagement of the second pusher against the central film portion of the packaging film. Such switching arrangements comprise a pair of dancer bars, each entrained with a portion of the packaging film and normally engageable with a proximity switch for actuating a drive system for the packaging film.

BRIEF DESCRIPTION OF THE DRAWINGS

The invention will be described with reference to the appended drawings, wherein the numerals denote like elements, and.

DETAILED DESCRIPTION OF THE PREFERRED EMBODIMENT

Figure 1:
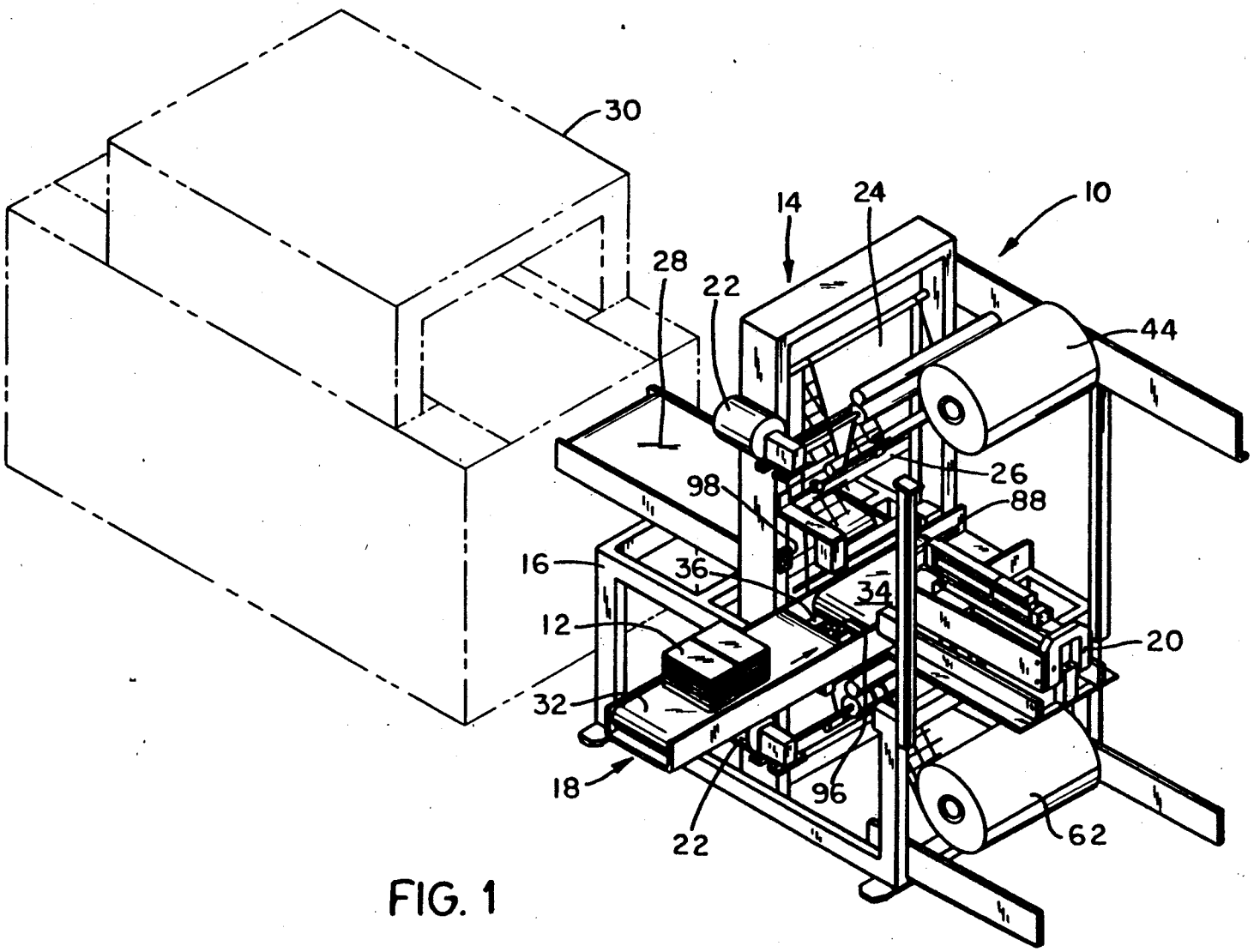
FIG. 1 is a fragmentary, perspective view of a wrapping machine embodying the present invention.
Figure 2:
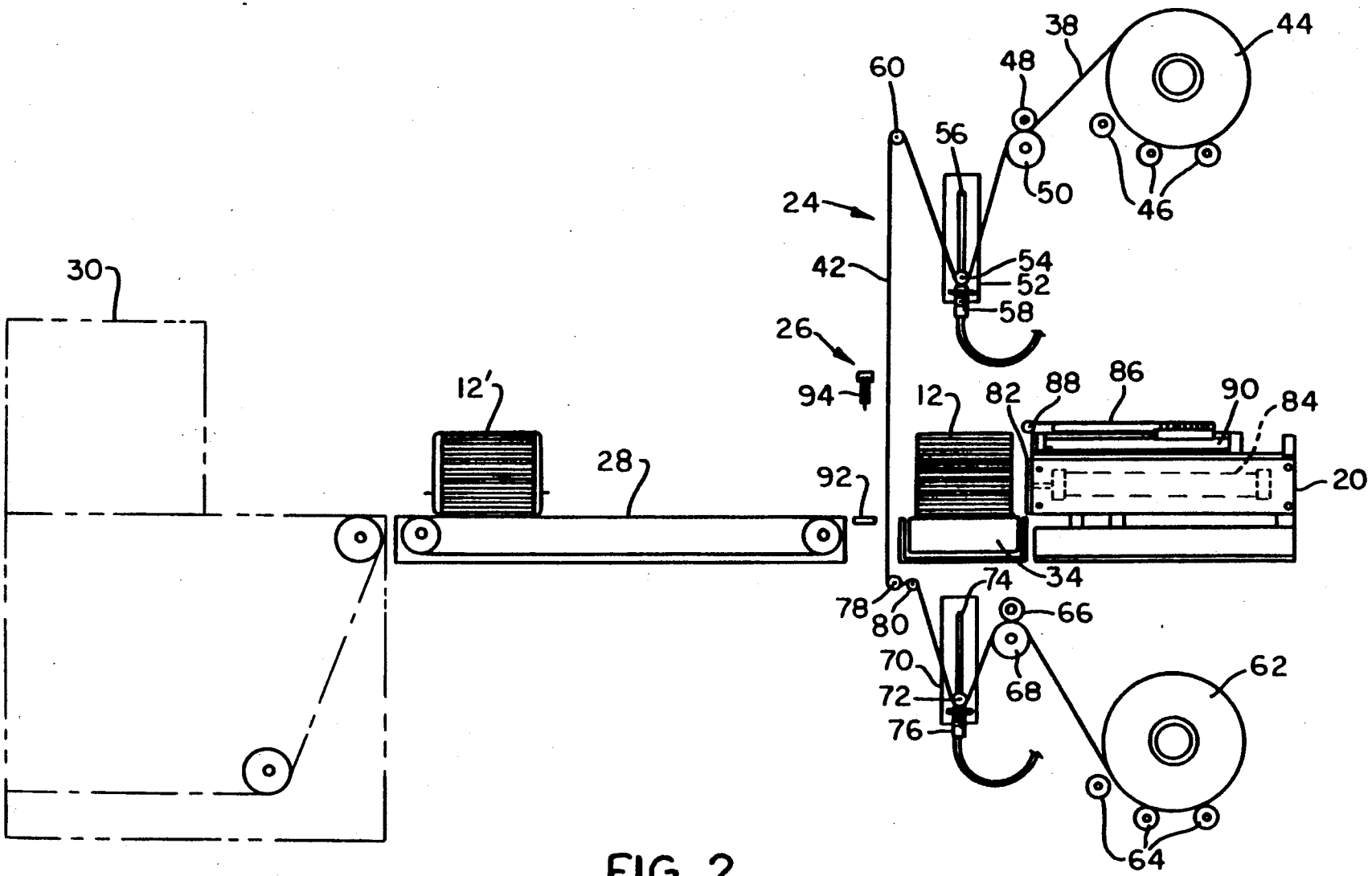
FIGS. 2–9 are various diagrammatical side views of the machine shown in FIG. 1 illustrating progressive working stages of the invention.
Figure 3:
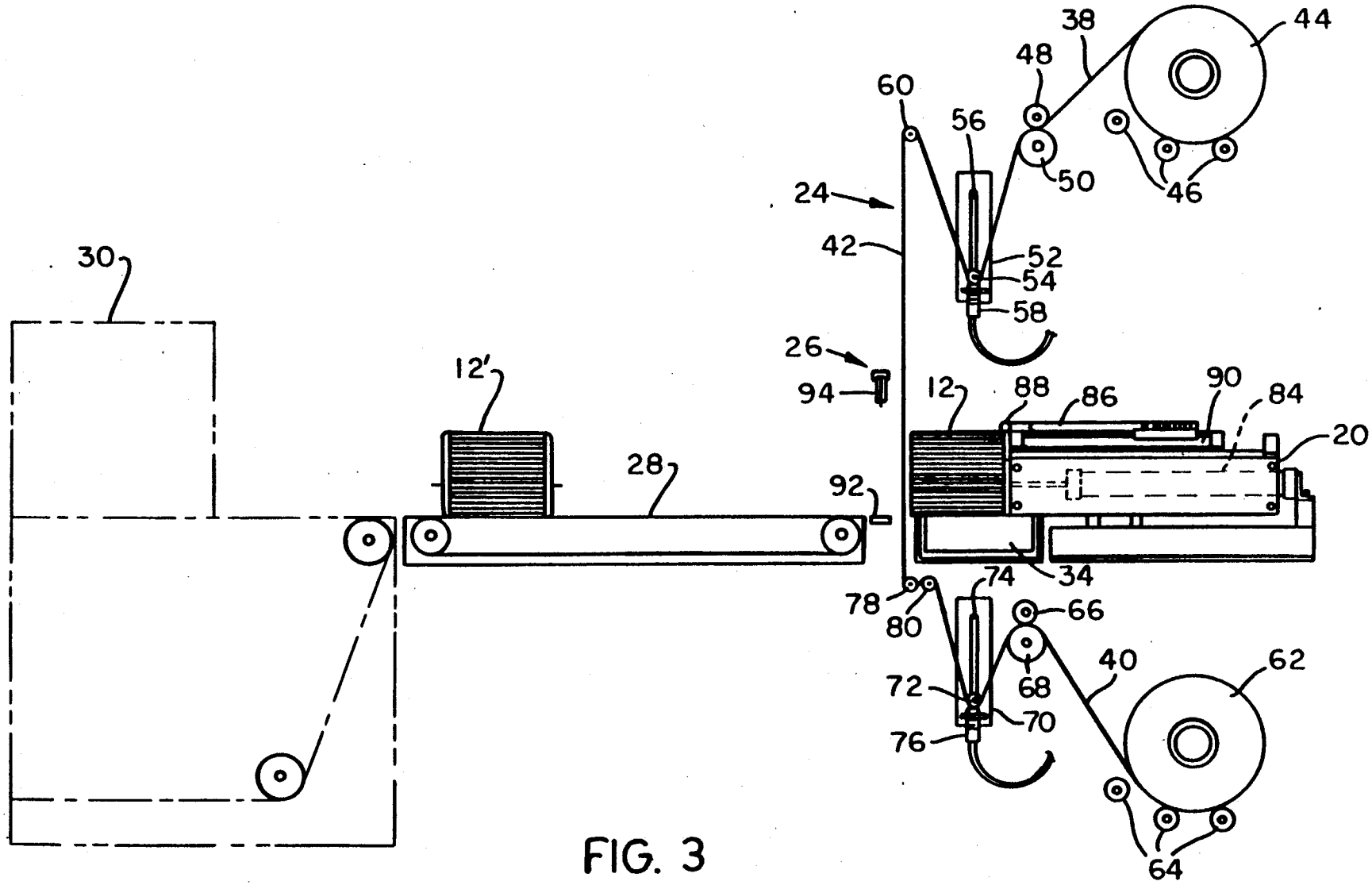
Figure 4:
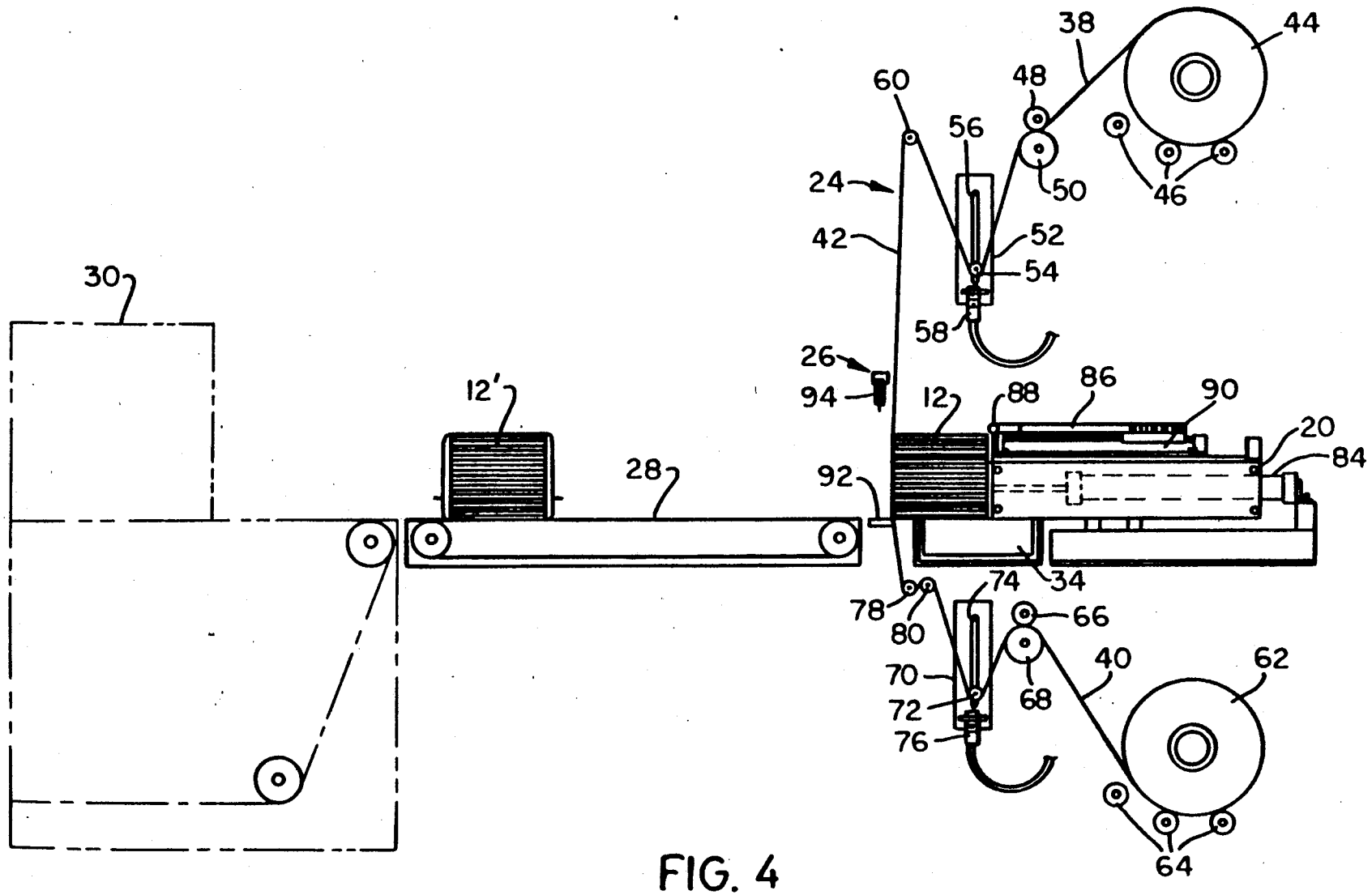
Figure 5:
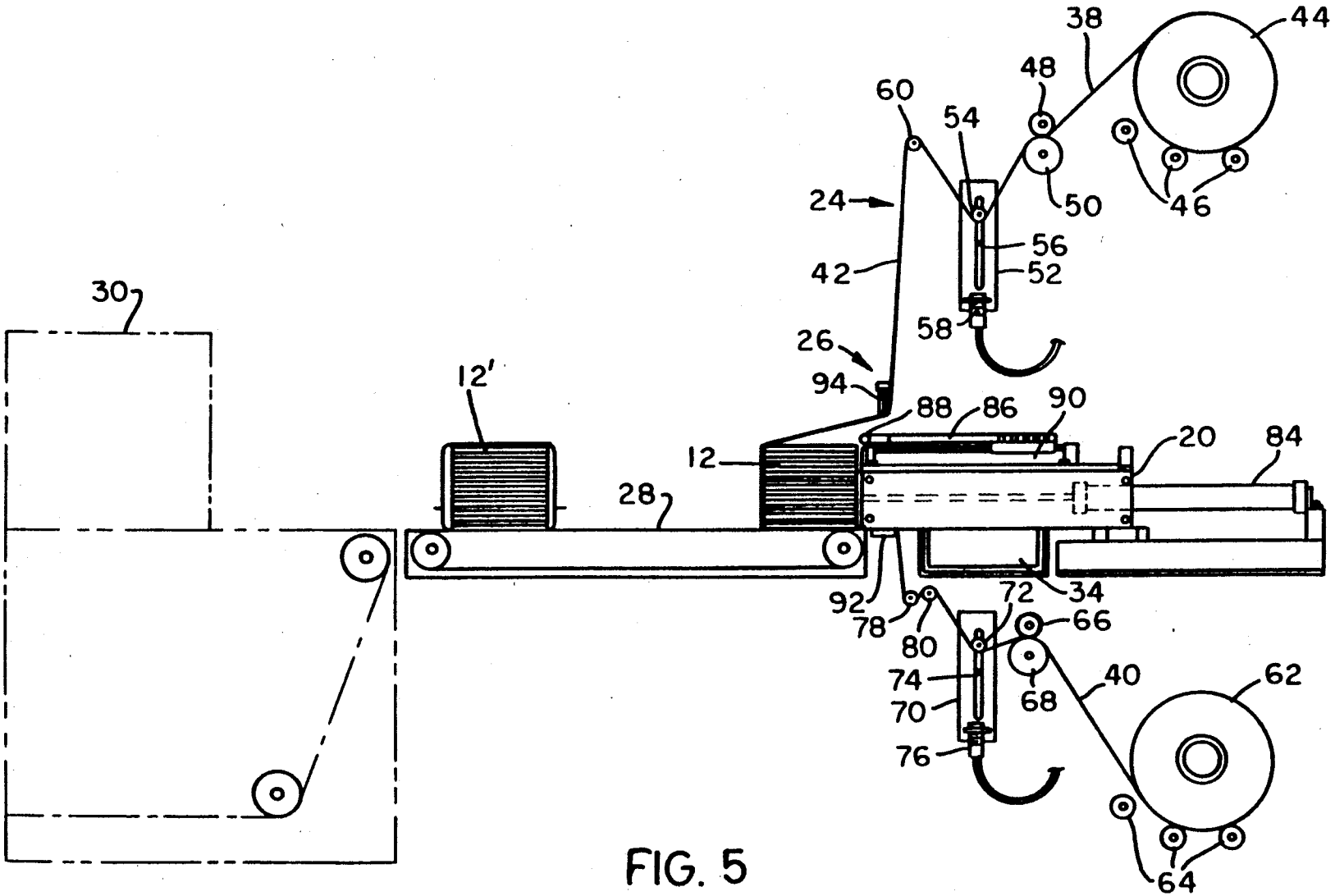
Figure 6:
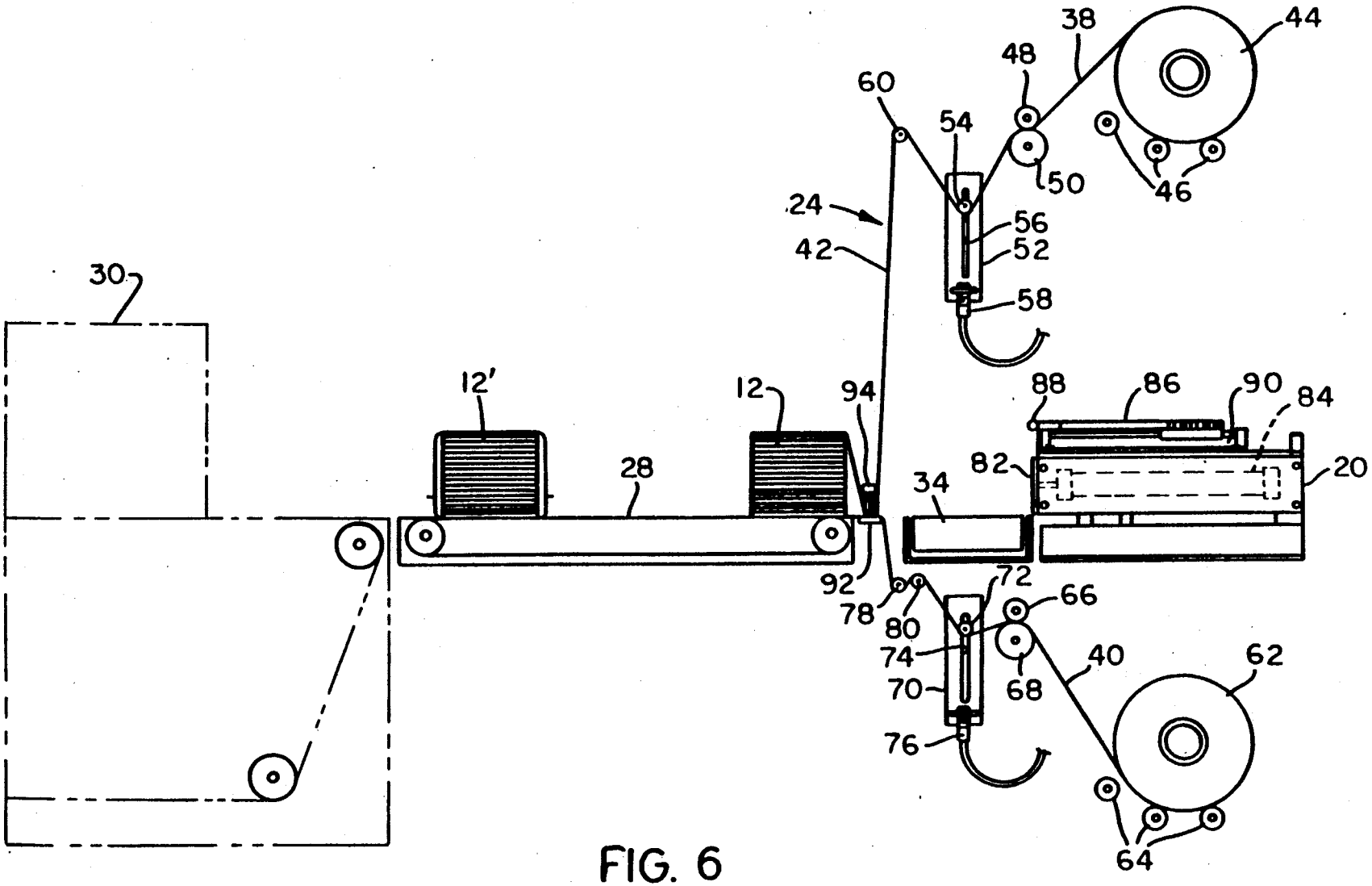

Referring first to FIG. 1, reference numeral 10 generally designates an apparatus for transferring signatures 12 to a wrapping machine 14 for forming a plastic package to protect signatures 12 during their delivery to various destinations. Wrapping machine 14 includes a framework 16 for supporting a plurality of operating units, namely an infeed conveyor system 18, a main pushing unit 20, a pair of upper and lower drive units 22 for dispensing continuous packaging film 24, a transversal welding unit 26, and an outfeed conveyor 28 to enable signatures 12 to be enveloped before being shrink wrapped in an auxiliary oven unit 30. Such machine 14 is conventionally recognized in the printing industry as an automatic sleeve wrapper which may be typically manufactured by Ideal Equipment Company Limited of Montreal, Canada.

Still referring to FIG. 1, infeed conveyor system 18 is provided for transporting individual as well as stacked and strapped, normally folded and printed signatures 12 along a substantially horizontal path in the direction shown by the arrow. Conveyor system 18 can advance signatures 12 from printing, folding, inserting, binding, stacking or strapping machines (not shown) or any other suitable source and comprises a first or infeed conveyor unit 32 cooperatively aligned with and slightly spaced from a second or pacer conveyor unit 34 by a small gap 36. Signatures 12 of various lengths, widths and heights travelling on conveyor unit 32 are intended to be conveyed smoothly across gap 36 onto conveyor unit 34.

As best depicted in diagrammatic FIGS. 2–6, continuous packaging film 24 has an upper film portion 38 and a lower film portion 40 welded together as is well known to form a central film portion or curtain 42 disposed substantially parallel to the path of conveyor units 32, 34. Upper film portion 38 is fed from an upper film supply roll 44 resting on a set of cradle rollers 46 and passes between an idler roller 48 and a motorized roller 50 which serves to positively drive upper film portion 38 via upper drive unit 22. Mounted on framework 16 above conveyor units 32, 34 is a pair of guide brackets 52, only one of which is seen in side view, which receive a dancer bar 54 movable upwardly and downwardly in slots 56 formed in guide brackets 52. Normally, the outer ends of dancer bar 54 are engageable by gravity against a pair of proximity switches 58 which are selectively actuated to energize upper drive unit 22 to drive upper film portion 38 from roll 44. Upper film portion 38 is entwined around the lower portion of dancer bar 54 and runs upwardly around an idler roller 60 from which it merges into central film portion 42.

Lower film portion 40, which is substantially a mirror arrangement of upper film portion 38, is metered from a lower film supply roll 62 supported on a set of cradle rollers 64 and then passes between an idler roller 66 and a motorized roller 68 which positive)y drive lower film portion 40 via lower drive unit 22. Again mounted on framework 16 but below conveyor units 32, 34 is a pair of guide brackets 70 which receive a dancer bar 72 movable upwardly and downwardly in slots 74 formed in guide brackets 70. In similar fashion, the outer ends of dancer bar 72 are normally engageable by gravity with selectively engageable proximity switches 76 so as to drive lower film portion 40 from roll 62 via lower drive unit 22. Lower film portion 40 is wrapped around a bottom portion of dancer bar 72 and runs upwardly around a pair of small idler rollers 78, 80 into merging relationship at central film portion 42 against which signatures 12 are to be wrapped.

Main pushing unit 20 is mounted on framework 16 in front of and directly transverse to conveyor units 32, 34 and central film portion 42. Included in this unit is a flat pushing element 82 extendably and retractably actuated by a hydraulic cylinder 84 to engage a side portion of and push signatures 12 across conveyor unit 34 in the direction of and into central film portion 42 which forms a packaging sleeve as signatures 12 travel therewith to be fully appreciated hereafter. A second or auxiliary pushing unit 86 is disposed in substantially parallel relationship on top of main pushing unit 20 and includes a T-bar pushing element 88 extendably and retractably actuated by a rodless cylinder 90 to selectively engage central film portion 42 in advance of signatures 12 transferred by pushing unit 20.

Also provided on an upright portion of framework 16 is transversal welding unit 26 located immediately behind and disposed for movement substantially parallel to central film portion 42. Welding unit 26 comprises a lower seal bar 92 fixed on framework 16 at substantially the same level as conveyor unit 34 and an upper, hydraulically-actuated, heated seal bar 94 normally situated at approximately the same height as second pushing unit 86 to allow stacked signatures 12 of variable height to pass under upper seal bar 94. As is conventionally known, when individual or a group of signatures 12 to be packaged has pushed packaging film 24 to the left and the trailing edge of the signature or bundle has passed the plane defined by central film portion 42, pushing unit 20 is retracted and upper seal bar 94 can be moved downwards to simultaneously shear and seal packaging film 24, creating a loose loop or envelope of plastic around signatures 12. When the upper seal bar 94 is raised, the signature package is released and the packaging film 24 is again readied for a new wrapping sequence.

Turning back to FIG. 1, wrapping machine 14 includes a first sensing device 96, such as a photocell or the like, located in gap 36 to detect the leading edge of signatures 12 after which main pushing unit 20 is suitably actuated to push signatures 12 across conveyor unit 34 into central film portion 42. In addition, a second sensing device 98, such as a photocell or the like, is mounted on framework 16 above conveyor unit 32 to monitor the height of signatures 12 travelling on conveyor unit 32. Second sensing device 98 suitably activates second pushing unit 86 if the height of signatures 12 is less than a predetermined level.

In use (FIG. 2), with the curtain or central film portion 42 formed by upper and lower film portions 38, 40, dancer bars 54, 72 rest against proximity switches 58, 76 so that motorized rollers 50, 68 are deenergized and film flow is in a static condition. Normally, when the leading edge of individual or groups of signatures 12 being advanced on conveyor unit 32 is detected by first sensing device 96, main pushing unit 20 receives a pushing signal to create a primary force against the side of signatures 12 (FIG. 3) as they are accelerated on conveyor unit 34 which typically runs at a faster speed than conveyor unit 32. The signatures 12 are thrust forwardly across conveyor unit 34 into central film portion 42 (FIGS. 4–5) creating a force on film 24 which lifts dancer bars 54, 72 away from proximity switches 58, 76 and actuates rollers 50, 68 to positively drive an appropriate amount of film 24 from upper and lower film supply rolls 44, 62. When the trailing edge of signatures 12 has passed the plane defined by central film portion 42 (FIG. 6), pushing unit 20 has been retracted and a loose loop of plastic has enveloped signatures 12, transversal welding unit 26 is moved downwardly to sever and seal film 24. Thereafter, welding unit 26 is reset, outfeed conveyor unit 28 is actuated to transfer the enveloped signatures 12' into oven 30 for heat shrinking and the completed package is then ready for distribution.

Figure 7:
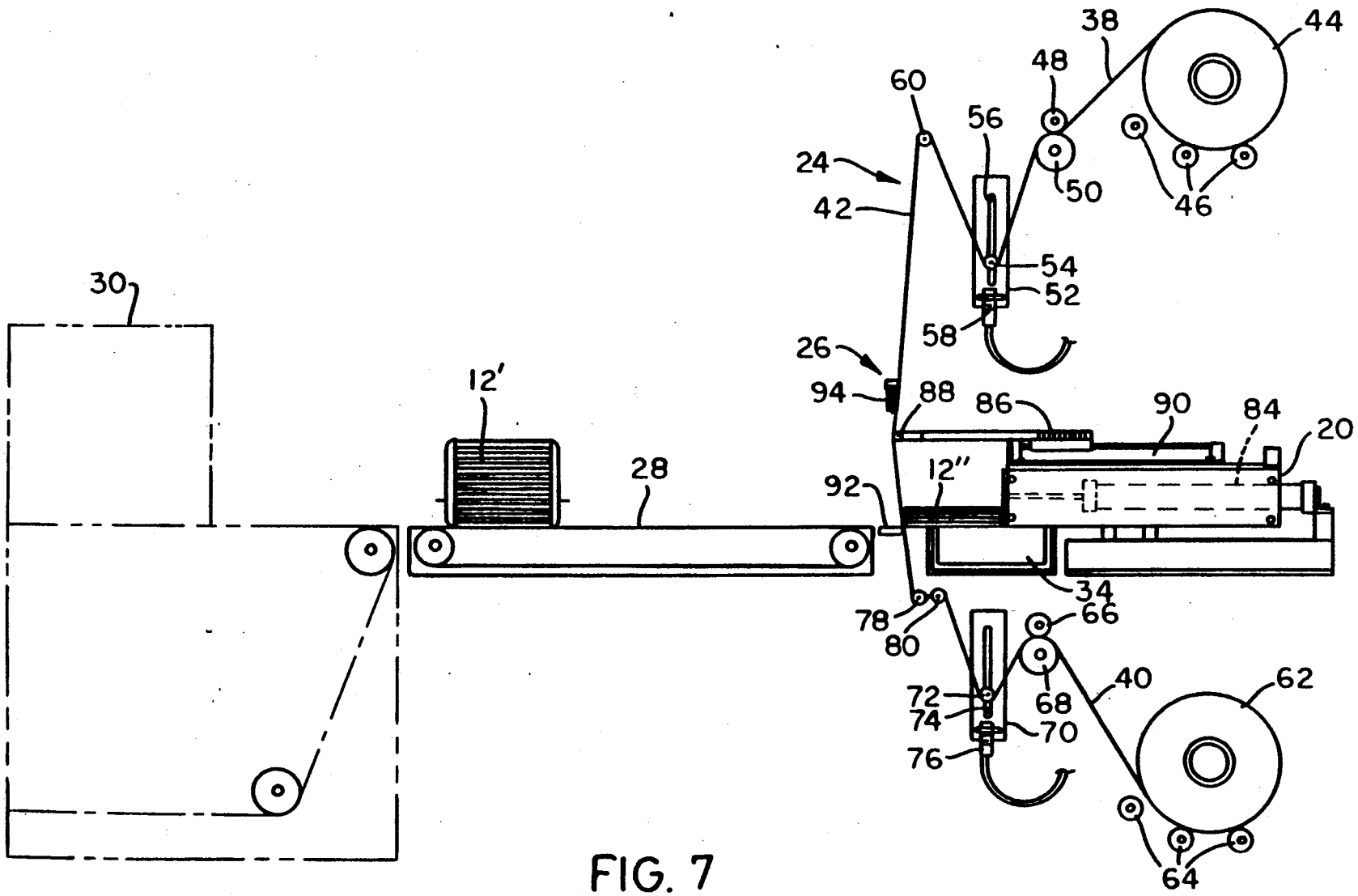
Figure 8:
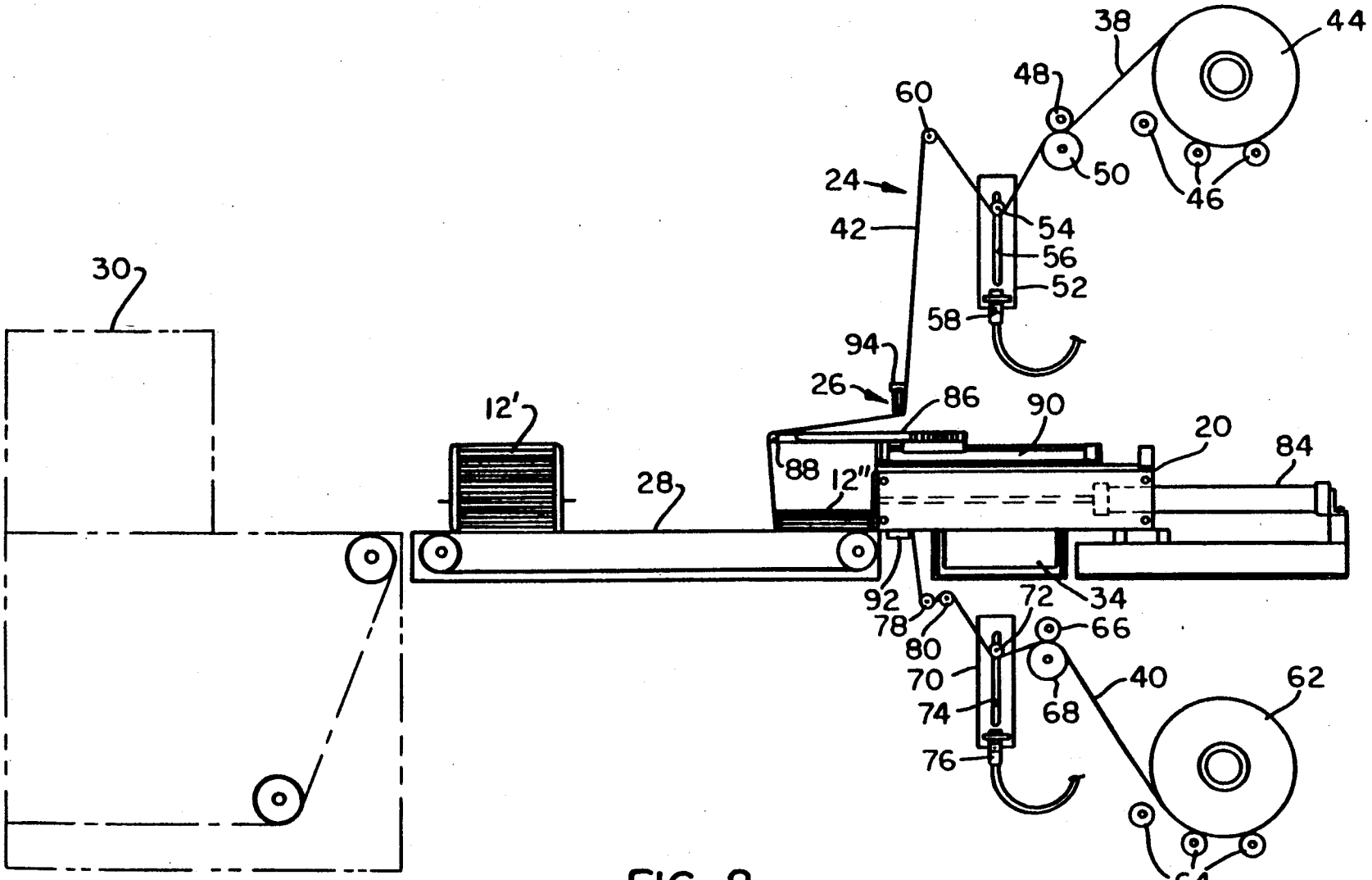
Figure 9:
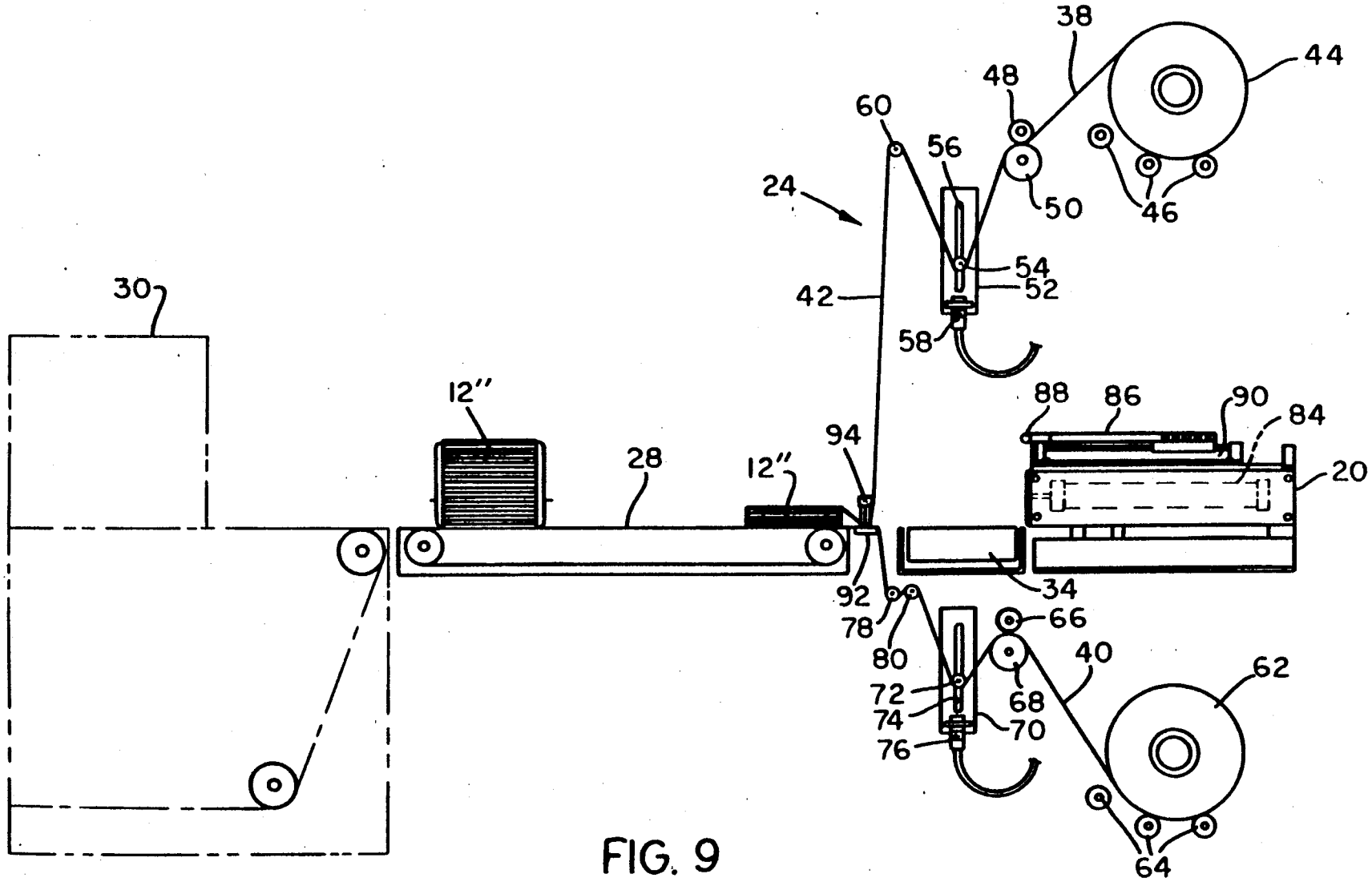

In accordance with the invention, if second sensing device 98 indicates that the height of signatures 12" on conveyor unit 32 is less than a predetermined level (FIG. 7), second pushing unit 86 is energized to deliver an auxiliary force in parallel relationship to main pushing unit 20 directly against central film portion 42 in advance of pushed signatures 12 contacting packaging film 24. As a result, the auxiliary force of second pushing unit 86 stimulates film to be positively driven (FIGS. 8–9) as hereto described, to avoid a tensile force on the leading edge of signatures 12" which would bend, distort or otherwise cause signatures 12" to climb central portion 42 and affect the proper film payout.

It should be appreciated that the present invention enhances the capability of a wrapping machine especially for low height, overlapped products having a flexibility which could affect the overall quality of packaging. Such capability is attained with an attendant 10–15% savings in plastic film consumption and without causing significant losses in operating speed. The preferred form of the invention is easily adaptable to existing push-type wrapping machines and continues to offer particular versatility in handling flexible, overlapped products such as signatures having various lengths, widths and heights.

Unlike prior art systems which supply unbalanced compensation to an upper portion of the packaging film, the present invention contemplates a more responsive, balanced packaging operation made possible by the location, function and central film application of second pushing unit in conjunction with a film system positively driven from the upper and lower ends. With this innovative arrangement, there is no need to assist the progress of the lower film portion with suction or similar pulling devices as previously employed.

While the invention has been described with reference to a preferred embodiment, those skilled in the art will appreciate that certain substitutions, alterations and omissions made be made without departing from the spirit thereof. Accordingly, the foregoing description is meant to be exemplary only and should not be deemed limitative on the scope of the invention set forth in the following claims.

We claim:

1. An apparatus for transferring at least one signature into a wrapping machine having a continuous, vertically oriented packaging film defined by an upper film portion, a lower film portion and a central film portion about which said at least one signature is wrapped, the apparatus comprising:

conveyor means for transporting said signature(s) along a path spaced from said packaging film;

first pushing means engageable with said signature(s), for advancing the same transversely across said conveyor means and into said packaging film; and second pushing means mounted on and in substantially parallel relationship with said first pushing means, said second pushing means being selectively engageable with the central film portion of said packaging film in response to the predetermined height of each said signature(s) and selectively extendable ahead of said signature(s) having said predetermined height for adjusting the tension of said packaging film to prevent distortion of said signature(s) during wrapping thereof.

2. The apparatus of claim 1, wherein said conveyor means comprises a first infeed conveyor means operated at a first speed and a second pacer conveyor means operated a second speed greater than said first speed.

3. The apparatus of claim 1, wherein said second pushing means is mounted directly above said first pushing means.

4. The apparatus of claim 1, wherein said second pushing means comprises a T-bar pushing element.

5. The apparatus of claim 1, wherein said apparatus includes first sensing means located above said conveyor means for detecting the height of said signature(s) on said conveyor means.

6. The apparats of claim 2, wherein said apparatus includes second sensing means located between said first infeed conveyor means and said second pacer conveyor means for detecting the presence of said signature as it approaches said second pacer conveyor means.

7. The apparatus of claim 5, wherein said second pushing means is responsive to said first sensing means.

8. The apparatus of claim 6, wherein said first pushing means is responsive to said second sensing means.

9. An apparatus for wrapping flexible, sheet-like product of variable height in a wrapping machine having a continuous, vertically oriented packaging film defined by an upper film portion, a lower film portion and a central film portion about which said products are wrapped, said apparatus comprising:

first pushing means engageable with one side of said products for advancing said products into said packaging film;

second pushing means selectively and transversely engageable with the central film portion of said packaging film in response to the predetermined height of products approaching said first pushing means and selectively extendable ahead of said products having said predetermined height; and vertically displaceable packaging film switching means for controlling a driven payout of the upper and lower film portions of said packaging film in response to engagement of either said products or said second pushing means against the central film portion of said packaging film.

10. The apparatus of claim 9, wherein said switching means comprises a pair of dancer bars and respective proximity switches of said dancer bars, each being entrained with a portion of said packaging film, and normally engageable with one of said proximity switches for actuating a drive means for said packaging film.

11. The apparatus of claim 9, wherein said apparatus includes an outfeed conveyor means on the side of said packaging film opposite said first pushing means and said second pushing means for transporting wrapped products into a shrinking oven.

12. A method of transferring at least one flexible product of variable height into a wrapping machine having a continuous, vertically oriented packaging film defined by an upper film portion, a lower film portion and a central film portion about which said product is wrapped, said method comprising the steps of:

applying a primary force against the side of said at least one flexible product to advance said product transversely across a conveyor means into contact with said packaging film; and selectively applying an auxiliary pushing force transversely against the central film portion of said packaging film substantially parallel to said primary force and in advance of said product contacting said packaging film in response to said product having a height less than that of a predetermined level such that the tension of said packaging film is adjusted to prevent distortion of said product during wrapping.

* * * * *